US005462043A

United States Patent [19]

Rose et al.

[11] Patent Number: 5,462,043

[45] Date of Patent: Oct. 31, 1995

[54] WOOD BURNING FURNACE

[76] Inventors: Keith J. Rose, 1347 Fleck Rd., P.O. Box 119, Six Lakes, Mich. 48886; William S. Rose, 4697 Jefferson Rd., Lakeview, Mich. 48850

[21] Appl. No.: 338,321

[22] Filed: Nov. 14, 1994

[51] Int. Cl.[6] ..... F24H 3/02

[52] U.S. Cl. ..... 126/110 R; 126/110 E; 126/77; 126/67; 126/502

[58] Field of Search ..... 126/110 R, 110 E, 126/77, 67, 502, 516, 517

[56] References Cited

U.S. PATENT DOCUMENTS

| | | | |
|---|---|---|---|
| 4,047,515 | 9/1977 | Daniel | 126/110 R |
| 4,347,831 | 9/1982 | Grazlano | 126/83 |
| 4,404,954 | 9/1983 | Steel | 126/121 |
| 4,545,360 | 10/1985 | Smith et al. | 126/77 |
| 4,596,231 | 6/1986 | Chelminski | 126/67 |
| 4,632,090 | 12/1986 | York | 126/110 E |
| 4,724,798 | 2/1988 | Alspaugh | 126/77 |
| 4,738,241 | 4/1988 | Bernelov et al. | 126/123 |
| 4,854,298 | 8/1989 | Craver | 126/77 |
| 5,014,680 | 5/1991 | Siemer | 126/77 |

*Primary Examiner*—Carroll B. Dority

*Attorney, Agent, or Firm*—David L. Baker; Rhodes & Ascolillo

[57] ABSTRACT

A unitary furnace through which air is circulated for heating purposes is disclosed. A blower forces air through a number of heat exchange tubes horizontally positioned within the combustion chamber for space heating purposes. Another blower is provided for the delivery of air to the burning material disposed upon a fuel support frame within the combustion chamber through an air distribution manifold. The manifold is fitted within the combustion chamber and has a number of air discharge openings positioned above and below the fuel support frame. These openings are oriented and arranged to direct the air passing therethrough generally inwardly toward the fuel on the fuel support frame. An electrical circuit including temperature sensors is provided for regulating air flow from each of the two blowers. One sensor is positioned in the furnace flue outlet and the other sensor is positioned exteriorly of the furnace in the space to be heated.

12 Claims, 2 Drawing Sheets

WOOD BURNING FURNACE

BACKGROUND OF THE INVENTION

1. Field of the Invention

The present invention relates generally to a furnace for heating the interior space of a building structure through the combustion of solid materials such as wood or coal.

2. Description of the Related Art

Improved wood burning stoves and furnaces have been proposed in prior U.S. patents. In an effort to improve efficiency in extracting heat from the burning fuel, these devices typically include a firebox surrounded by an enclosing cabinet through which air may be circulated to extract heat.

U.S. Pat. No. 4,047,515, issued Sep. 13, 1977 to Walter L. Daniel, modifies such a device by providing a blower for forcing air into the interior of the firebox through louvers located on the opposite side walls of the firebox at a level adjacent the fire. Although a significant improvement over the prior art, the delivery of air to the fire at widely spaced apart points is less than optimum. Further, the continued use of large juxtaposed compartments for extracting heat from the fire fails to derive as much heat as possible from the fire.

U.S. Pat. No. 4,404,954 issued Sep. 20, 1983 to Steel discloses a fireplace furnace comprised of: an enclosed primary combustion chamber and a primary air supply for the initial burning of fuel; a separate enclosed secondary combustion chamber and a secondary air supply for burning any volatile gases remaining from the combustion in the primary chamber; and an enclosed room air heating chamber. The secondary combustion chamber is located between the primary chamber and the room air chamber. The flow of the air of the room air chamber is counter to the flow of flue gas in the secondary chamber, so that the heat transferred to the room air is from the flue gas of the secondary combustion chamber and none of the heat transferred to the room air is transferred directly from the primary combustion chamber.

U.S. Pat. No. 4,596,231, issued Jun. 24, 1986 to Chelminski shows a self-cleaning high heat exchange wood or coal stove which includes an interior cylindrical squirrel-cage configured fuel grate comprised of parallel air-conducting pipes for heating cold air forced by a blower. This stove relies on the cyclical condensation and combustion of effluent deposits as the interior cylindrical fuel grate is rotated by the user turning a handle.

U.S. Pat. No. 4,347,831 issued Sep. 7, 1982 to Graziano describes a fuel burning stove having a stove housing and a combustion chamber. The flue has a flue passage back to a lower portion of the combustion chamber so that unburned gaseous products of combustion rise toward the top of the chamber and are trapped and forced back downward through the chamber to be passed through the flame of combustion another time with the purposes of promoting efficient combustion and a cleaner combustion residue.

U.S. Pat. No. 4,738,241 issued Apr. 19, 1988 to Bernelov et al. provides a woodburning stove whose efficiency is increased by: preheating inlet air before it enters heat exchange tubes in the firebox; discharging hot air from a jacketed airspace along with hot air from the heat exchange tubes; deflecting discharged hot air downward; deflecting fire and hot gases from the firebox away from the flue so they must transfer heat to the top of the stove before they enter the flue; and, lastly, providing a second grate below the heat exchange tubes in order to catch falling burning embers.

The efficient combustion of flammable materials in wood burning furnaces has long been a cause for concern. Many of these devices have a tendency to develop extremely hot fires, consuming excessive amounts of wood and causing furnace components to warp or crack under the high temperatures which are developed. On the other hand, other furnace models incompletely combust the materials placed therein. The resulting inefficiency of the process of combustion thus increases the amount of fuel required to adequately heat a given space and increases the amount of pollutants released into the environment.

These efficiency problems have been attributed principally to the manner in which air for combustion is supplied to the fuel disposed in the firebox of the furnace. Usually, air is introduced beneath a frame on which the fuel is supported and flows upwardly through the burning materials. In certain instances, the rate of air flow to the fuel is greater than that required for optimum burning, causing an unnecessarily hot fire to develop and large amounts of fuel to be wasted. On the other hand, if air delivery rates are too low, the fuel may not burn completely. Thus, a need exists for a furnace which is able to efficiently combust fuel with a relatively low temperature fire as well as efficiently extract the resultant heat for warming the interior of a building structure.

SUMMARY OF THE INVENTION

The present invention, in a preferred embodiment, provides a wood burning furnace comprising: an enclosed combustion chamber including a top, a bottom, a back, a front and opposing side walls; a fuel supply opening to the combustion chamber, a door supported for movement to open and close the supply opening; a fuel support frame located within the enclosed combustion chamber for supporting fuel materials therewithin; an air distribution manifold disposed within the combustion chamber having a first opening disposed above the fuel support frame and a second opening disposed below the fuel support frame, the first and the second outlet openings being oriented and arranged to direct air passing therethrough generally toward the fuel materials on the fuel support frame; a combustion air blowing means for blowing air through the first and the second outlet openings; and a flue outlet extending from the combustion chamber for directing exhaust gases therefrom.

The air distribution manifold further includes at least one vertically oriented C-shaped conduit having a bottom leg for positioning the C-shaped conduit adjacent the bottom wall, a vertical leg for positioning the C-shaped conduit adjacent the front wall, and a top leg for positioning adjacent the top wall. The bottom, vertical, and top legs are in internal fluid communication with one another. The top leg is disposed above the fuel support frame. The bottom leg is disposed below the fuel support frame. The first outlet opening is disposed in the top leg, and the second outlet opening is disposed in the bottom leg.

The air distribution manifold further includes a plurality of the C-shaped conduits, at least one of the conduits being positioned adjacent each of the opposed side walls of the enclosed combustion chamber.

The top leg of a C-shaped conduit includes a plurality of the first outlet openings, the first outlet openings being arranged to direct air passing therethrough downwardly and inwardly toward the fuel support frame, and the bottom leg includes a plurality of second outlet openings, the second outlet openings being arranged to direct air passing therethrough upwardly and inwardly toward the fuel support frame.

The combustion air blowing means further includes a front plenum disposed adjacent the front wall and interiorly of the combustion chamber.

The preferred embodiment of the present invention further comprises a plurality of heat exchange tubes disposed within the combustion chamber; and an air circulation means for circulating air through the heat exchange tubes.

The air circulation means includes: a rear plenum disposed adjacent the rear wall and exteriorly of the combustion chamber, the heat exchange tubes being in fluid communication with the rear plenum; and a circulating air blower for delivering air to the rear plenum.

Preferably, the heat exchange tubes are horizontally and parallely disposed adjacent the top wall of the combustion chamber, the heat exchange tubes being disposed above the fuel support frame. Moreover, the heat exchange tubes are positioned in a spaced-apart configuration resembling an inverted and truncated pyramid.

The preferred embodiment further comprises an electric circuit including a limit switch for controlling the combustion air blowing means, the limit switch being located and adapted to sense the temperature within the flue outlet and being coupled with the combustion air blowing means to effect the termination of the air flow from the combustion air blowing means when the temperature in the flue outlet exceeds a preselected temperature.

The electric circuit further comprises a thermostat for controlling the air circulation means, the thermostat being located and adapted to sense the temperature exteriorly of the furnace and being coupled with the air circulation means to effect the termination of the air flow from the air circulation means when the temperature exteriorly of the furnace exceeds a preselected temperature.

In an alternate embodiment, the present invention is a wood burning furnace, comprising: an enclosed combustion chamber including top, bottom, back, front and opposing side walls; a fuel supply opening to the combustion chamber disposed in the front wall, a door supported for movement to open and close the supply opening; a fuel support frame located within the enclosed combustion chamber for supporting fuel materials therewithin; and an air distribution manifold disposed within the combustion chamber having a plurality of first openings disposed above the fuel support frame and a plurality of second openings disposed below the fuel support frame, the plurality of first and second outlet openings being oriented and arranged to direct air passing therethrough generally inwardly toward the fuel support frame.

The air distribution manifold further includes a plurality of vertically oriented C-shaped conduits, at least one of the conduits positioned adjacent each of the opposed side walls of the enclosed combustion chamber. Each of the C-shaped conduit has a bottom leg for positioning adjacent the bottom wall, a vertical leg for positioning adjacent the front wall, and a top leg for positioning adjacent the top wall. The bottom, vertical, and top legs are in fluid communication with one another, the top leg having the plurality of first outlet openings, and the bottom leg having the plurality of second outlet openings.

The alternate embodiment further comprises: a combustion air blowing means for blowing air through the plurality of first and second outlet openings for combustion of the fuel material; a flue outlet extending from the combustion chamber for directing exhaust gases therefrom; a plurality of heat exchange tubes horizontally and parallely disposed within the combustion chamber adjacent the top wall thereof, the heat exchange tubes being positioned in an inverted, pyramidal configuration; an air circulation means for circulating air through the heat exchange tubes, the air circulation means including a rear plenum disposed adjacent the rear wall and exteriorly of the combustion chamber, the heat exchange tubes being in fluid communication with the rear plenum; and a circulating air blower for delivering air to the rear plenum.

The alternate embodiment further comprises an electric circuit including a limit switch for controlling the combustion air blowing means, the limit switch being located and adapted to sense the temperature within the flue outlet and being coupled with the combustion air blowing means to effect the termination of the air flow from the combustion air blowing means when the temperature in the flue outlet exceeds a preselected temperature, and a thermostat for controlling the air circulation means, the thermostat being located and adapted to sense the temperature exteriorly of the furnace and being coupled with the air circulation means to effect the termination of the air flow from the air circulation means when the temperature exteriorly of the furnace exceeds a preselected temperature.

It is a primary object of the present invention to provide a wood burning furnace which efficiently combusts fuel with a relatively low temperature fire and which efficiently extracts the resultant heat in order to warm the interior of a building.

It is an additional object of this invention to provide such a wood burning stove which includes separate forced air pathways for delivery to the fuel combustion area and for delivery of room warming air around the combustion area and into the room.

It is an object of the invention to provide improved elements and arrangements thereof in a wood burning furnace for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 2:
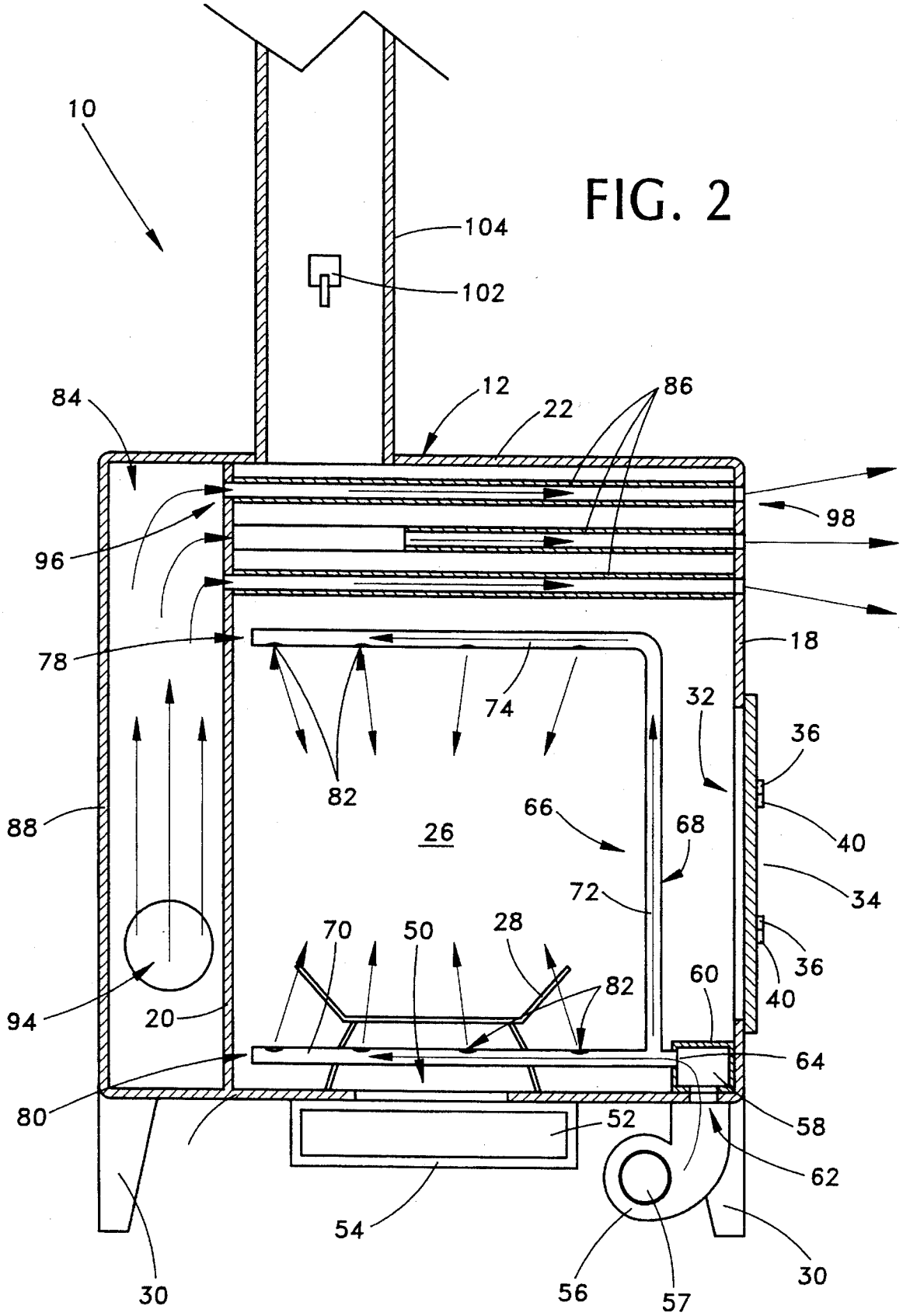
FIG. 2 is a cross-sectional view of the furnace taken along line 2—2 of FIG. 1.

Referring now to the figures, a wood burning furnace 10 in accordance with the present invention is illustrated. The furnace 10 has a firebox 12 including opposing side walls 14 and 16, front and rear walls 18 and 20, respectively, a top wall 22, and a bottom wall 24. The interior of the firebox 12 provides an enclosed combustion chamber 26 (FIG. 2) for burning wood, coal, paper, or any like combustible fuel. A fuel support frame 28 is placed inside the combustion chamber 26 to support the fuel material (not shown) above the bottom wall 24 to increase air circulation through the fuel material during burning. L-shaped legs 30, positioned at each of the four corners of the rectangular bottom wall 24, retain the combustion chamber 26 at a predetermined elevation above a horizontal supporting surface such as a floor. The legs 30 and all of said walls, 14, 16, 18, 20, 22, and 24, comprise metallic plates welded together in a unitary construction.

A fuel supply opening 32 (FIG. 2) is provided in the front wall 18 of the firebox 12 to permit access to the combustion chamber 26 so that the fuel supply may be replenished. A door 34 is hingedly mounted upon the front wall 18 so as to provide a closure for the opening 32. To prevent the escape of combustion products between the door 34 and the sides of the fuel supply opening 32, a sealing element (not shown) may be secured about the periphery of the door 34 or to the front wall 18 about the periphery of the opening 32. A pair of hinge arms 36 are pivotally pinned by pins 38 to mounting brackets 40 which extend from the front wall 18. The hinge arms 36 extend horizontally away from the brackets 40 in a parallel relationship. A toggle-type latch 42 (FIG. 2) is provided to secure the door 34 in a closed position over the opening 32. Stop pins 44 and 46 secured, respectively, above and below the pivoting latch handle 48 prevent excessive rotational travel of the handle during opening and closing. Latch handle receiver 43 extends outwardly from front wall 18 and upwardly in a position to receive and secure the pivoting latch handle 48. Pivoting latch handle 48 is mounted by pivotal pin 45, and has a grasping pin 47 mounted at an end opposite to the pivotal mounting point.

Positioned in the bottom wall 24 of the firebox 12 is opening 50 for the discharge of ash and other solid waste products as is typical of these types of stoves. The opening 50 is partially covered by a plate or grate (neither shown) for preventing the inadvertent discharge of large, burning embers or the like through the opening 50. A sliding drawer 52 is suspended beneath the opening for the receipt of ash, etc., by a drawer retaining frame 54 of steel plate construction. The drawer 52 has a lateral extent at least as great as that of the opening 50 so as to catch all of the debris discharged through the opening. Drawer retaining frame 54 and sliding drawer 52 are mounted such that the sliding drawer 52 slides in and out perpendicularly to side wall 14 or side wall 16. Sliding drawer 52 is provided with a handle (not shown) to facilitate sliding the drawer 52.

The combustion chamber 26 is provided with a forced air supply. In this regard, an air blower 56 of well-known construction is positioned near the front of the firebox 12 and securely fastened to the bottom wall 24 thereof. The blower 56 is provided with an air inlet 57 for allowing air to be impelled from the space beneath the firebox into a chamber or plenum 58 disposed within the firebox 12 at the outlet of blower 56.

The plenum 58 comprises a length of relatively large diameter square tubing 60 which may span the lateral length of the front wall 18, engaging each of the opposing side walls 14 and 16, or, preferably, may be cut shorter so that the tubing 60 partially bridges the gap from one side wall to the other. If a shorter length of tubing is used, its ends must be closed, as with the application of a metallic caps onto each end of tubing 60. As a practical matter, any length of square tubing sufficient to receive the discharge of the blower 56 without substantially restricting the flow therefrom is adequate for the purposes described. By shortening the length of the tubing 60, the weight of the furnace 10 will be slightly reduced.

The plenum 58 is provided with a single air inlet 62 and a single air outlet 64 through which air delivered from the blower 56 may be directed. The air passage or inlet 62 is presented between the bottom wall 24 and the bottom of the tubing 60 so as to receive air from the blower 56 and transmit such to the plenum 58. The rearward side of the tubing 60 is provided with an outlet 64 through which the forced or compressed air enters a distribution manifold 66 for delivery to the burning fuel within the combustion chamber 26.

The air distribution manifold 66 includes two vertically oriented C-shaped conduits 68 positioned on each side of the combustion chamber 26 proximate side walls 14 and 16. Each of the C-shaped conduits 68 has a bottom leg 70, a vertical leg 72, and a top leg 74. A horizontal connector leg 76 joins the C-shaped sections together and, itself, is in fluid communication with the outlet 64 of plenum 58. The legs 70, 72, 74, and 76 are hollow, formed of metallic tubing having either a square or circular cross section, and in fluid communication with one another so as to permit the passage of air therebetween. Each bottom leg 70 is disposed adjacent the bottom wall 24 and the respective ends of bottom leg 70 are positioned near the front and rear walls 18 and 20. Extending upwardly from the front end of each bottom leg 70 and positioned adjacent the front wall 18 is a vertical leg 72 for conducting air to the top leg 74. The top leg 74 is disposed adjacent the top wall 22 and has its ends positioned substantially parallel and above those of bottom leg 70. The distal end 78 and 80, respectively, of the top and bottom legs 74 and 70 are capped to prevent the flow of air therefrom.

The top and bottom legs 74 and 70 have been provided with a plurality of orifices 82 for the even delivery of pressurized air from the manifold 66 to all portions of the burning fuel material disposed within the combustion chamber 26. The orifices 82 are provided in an evenly spaced-apart relationship along each top leg 74 so as to direct air diagonally, downwardly and inwardly, toward the fuel support frame 28 as well as along each bottom leg 70 so as to direct air diagonally upwardly and inwardly, toward the fuel support frame as shown by the arrows in FIGS. 1 and 2. The downward flow of air from the top leg 74 has been found to recirculate unburned volatile materials, whether in a gaseous or solid state, back to the flames emanating from the burning fuel disposed upon the frame 28 for combustion rather than permitting their immediate discharge to the atmosphere as is the case with many prior art furnaces. The diameter of each orifice 82 is large enough to permit the sufficient flow of air to the burning fuel to maintain a relatively low temperature but thorough-burning fire. Inversely, each orifice 82 is small enough to provide a high air discharge velocity so as to eject any solid materials which may happen to fall on an orifice 82. Thus, each orifice 82 can be considered to be self-cleaning.

The heat generated within the firebox 12 is transferred to air which is forced through the reservoir or plenum 84 at the rear of the firebox 12 and through the heat exchange tubes 86 horizontally disposed within the combustion chamber 26 itself. The plenum 84 is bounded by each of the firebox walls except the front wall 18. To provide a rear closure for the plenum 84, a back wall 88 is provided. The back wall 88 is joined about its periphery to the side walls, 14 and 16, and the top and bottom walls, 22 and 24, by welding in an airtight fashion.

A second self-contained air blower 90 of well known construction is positioned to the rear of the firebox 12 and securely fastened to the exterior of right side wall 16 such that air blower 90 may force air directly into plenum 84. The blower is provided with an air inlet 92 for allowing air to be impelled from the space surrounding the furnace into the plenum 84. The right side wall 16 is provided with an air duct 94 through which air is delivered from the blower 90 into the plenum 84. The upper end of rear wall 20 is provided with a plurality of outlets 96 through which air can pass from the plenum 84 into the heat exchange tubes 86.

Figure 1:
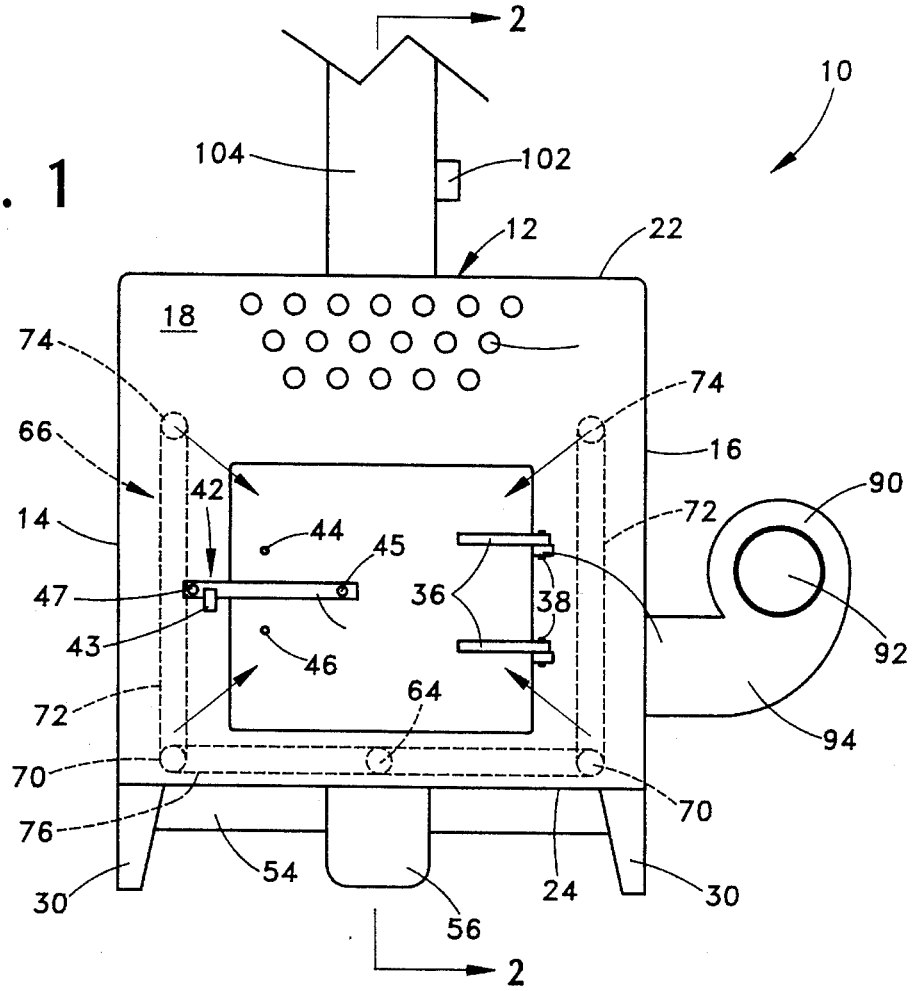
FIG. 1 is a front elevational view of a wood burning furnace in accordance with the present invention.

Preferably, each of the outlets 96 delivers air from the plenum 84 to one of eighteen closely spaced heat exchange tubes 86. Each of the tubes 86 is of square or round cross section and traverses the top of the enclosed combustion chamber 26 from rear to front so as to receive maximum heating during the combustion of a fuel material below. The tubes 86 are preferably positioned in a spaced-apart configuration resembling an inverted and truncated pyramid as shown in FIG. 1. Preferably, three, vertically-stacked rows of tubes 86 are provided, the lowermost row including five tubes and the middle and uppermost rows including six and seven tubes, respectively. This configuration is important because it places a large number of heat exchange tubes 86 directly above the heat source as well as near the top wall 22 of the firebox where high temperature gases emanating from the burning fuel collect prior to discharge from the firebox.

Each of the tubes 86 terminates in a outlet opening or orifice 98 within the top of front wall 18 for the discharge of heated air directly into the space adjacent the furnace exterior. For optimal utilization of the blower 90, it is preferable that the combined cross-sectional area of the outlets 98 be sufficient to discharge the volume of air delivered thereto by the blower 90 without appreciable back pressure. Deflectors and nozzles of well-known configuration (not shown) may be positioned at each outlet 98 to divert air to any desired location exteriorly of the firebox as well as to reduce frictional losses caused by the discharge of air through the otherwise abrupt opening.

Figure 3:
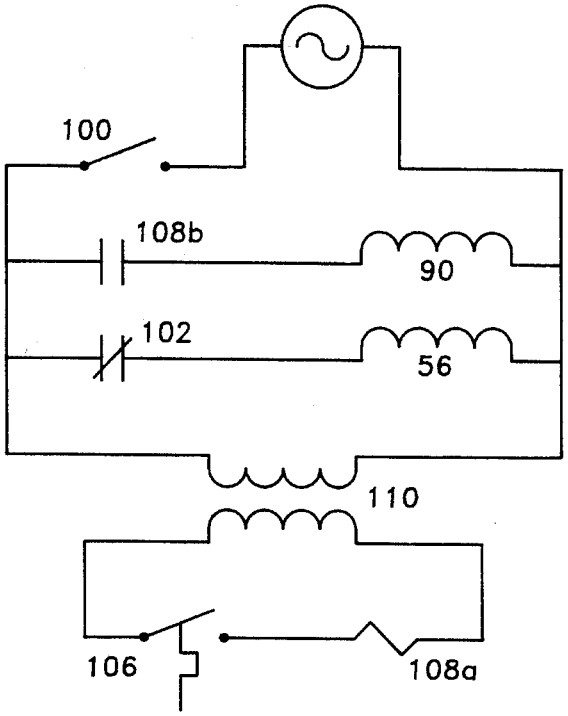
FIG. 3 is a schematic diagram of the electrical circuitry of the furnace.

The circulation of air through the furnace 10 is thermostatically controlled. When electrical power is supplied through the closing of the on/off switch, indicated schematically at 100 in FIG. 3, to the combustion chamber blower 56, air will be delivered through the manifold 66 to the interior of the combustion chamber 26 to aid in the burning of fuel materials positioned therein. The on/off switch 100 is preferably positioned remotely from the firebox 12 for convenience. A limit switch 102 serves to control the operation of the blower 56. The limit switch 102 is preferably mounted in the flue outlet 104 and has a set of normally closed electrical contacts which open when the temperature in the flue outlet 104 reaches a preselected temperature, preferably about 83 degrees Celsius. The opening of the contacts inside limit switch 12 deactivates the blower 56 by preventing the flow of electrical current thereto.

Positioned remotely from the firebox 12 is a conventional room thermostat 106 for activating the warm air blower 90 which is wired in parallel with blower 56. When the room temperature drops below a preselected level, the relay coil 108*a*, energized by transformer 110, closes relay contacts 108*b* thereby delivering an electrical current to the warm air blower 90 and causing air to be blown through the plenum 84 and the heat exchange tubes 86. When the temperature of the room has reached the preselected level, the relay contacts 108*b* open and stop the blower 90 thereby cutting off the flow of air through the heat exchange tubes 86. The limit switch 102 and the thermostat 106 thus act to keep the temperature of the fire and the room air at certain preselected temperature levels, conserving fuel and eliminating significant temperature fluctuations of the firebox and the room air.

It is to be understood that the present invention may be embodied in other specific forms and is not limited to the sole embodiment described above, but encompasses any and all embodiments within the spirit and scope of the following claims. Therefore, the present embodiment must be considered in all respects as illustrative only.

I claim:

1. A wood burning furnace, comprising:

an enclosed combustion chamber including a top, a bottom, a back, a front and opposing side walls;

a fuel supply opening to said combustion chamber, a door supported for movement to open and close said supply opening;

a fuel support frame located within said enclosed combustion chamber for supporting fuel materials therewithin;

an air distribution manifold disposed within said combustion chamber having a first opening disposed above said fuel support frame and a second opening disposed below said fuel support frame, said first and said second outlet openings being oriented and arranged to direct air passing therethrough generally toward the fuel materials on said fuel support frame;

a combustion air blowing means for blowing air through said first and said second outlet openings; and a flue outlet extending from said combustion chamber for directing exhaust gases therefrom.

2. A wood burning furnace according to claim 1, wherein said air distribution manifold further includes:

at least one vertically oriented C-shaped conduit having a bottom leg for positioning said C-shaped conduit adjacent said bottom wall, a vertical leg for positioning said C-shaped conduit adjacent said front wall, and a top leg for positioning adjacent said top wall;

said bottom, vertical, and top legs being in internal fluid communication with one another;

said top leg being disposed above said fuel support frame;

said bottom leg being disposed below said fuel support frame;

said first outlet opening being disposed in said top leg; and said second outlet opening being disposed in said bottom leg.

3. A wood burning furnace according to claim 2, wherein said air distribution manifold further includes:

a plurality of said C-shaped conduits, at least one of said conduits positioned adjacent each of the opposed side walls of said enclosed combustion chamber.

4. A wood burning furnace according to claim 2 wherein said top leg includes a plurality of said first outlet openings, said first outlet openings being arranged to direct air passing therethrough downwardly and inwardly toward said fuel support frame, and said bottom leg includes a plurality of second outlet openings, said second outlet openings being arranged to direct air passing therethrough upwardly and inwardly toward said fuel support frame.

5. A wood burning furnace according to claim 2 wherein said combustion air blowing means further includes a front plenum disposed adjacent said front wall and interiorly of said combustion chamber.

6. A wood burning furnace according to claim 1, further comprising:

a plurality of heat exchange tubes disposed within said combustion chamber: and air circulation means for circulating air through said heat exchange tubes.

7. A wood burning furnace according to claim 6, wherein said air circulation means includes:

a rear plenum disposed adjacent said rear wall and exteriorly of said combustion chamber, said heat exchange tubes being in fluid communication with said rear plenum; and a circulating air blower for delivering air to said rear plenum.

8. A wood burning furnace according to claim 6, wherein said heat exchange tubes are horizontally and parallely disposed adjacent the top wall of said combustion chamber, said heat exchange tubes being disposed above said fuel support frame.

9. A wood burning furnace according to claim 8, wherein said heat exchange tubes are positioned in a spaced-apart configuration resembling an inverted and truncated pyramid.

10. A wood burning furnace according to claim 1, further comprising:

an electric circuit including a limit switch for controlling said combustion air blowing means, said limit switch being located and adapted to sense the temperature within said flue outlet and being coupled with said combustion air blowing means to effect the termination of the air flow from said combustion air blowing means when the temperature in said flue outlet exceeds a preselected temperature.

11. A wood burning furnace according to claim 10, wherein said electric circuit further comprises:

a thermostat for controlling said air circulation means, said thermostat being located and adapted to sense the temperature exteriorly of said furnace and being coupled with said air circulation means to effect the termination of the air flow from said air circulation means when the temperature exteriorly of said furnace exceeds a preselected temperature.

12. A wood burning furnace, comprising:

an enclosed combustion chamber including top, bottom, back, front and opposing side walls;

a fuel supply opening to said combustion chamber disposed in said front wall, a door supported for movement to open and close said supply opening;

a fuel support frame located within said enclosed combustion chamber for supporting fuel materials therewithin;

an air distribution manifold disposed within said combustion chamber having a plurality of first openings disposed above said fuel support frame and a plurality of second openings disposed below said fuel support frame, said plurality of first and second outlet openings being oriented and arranged to direct air passing therethrough generally inwardly toward said fuel support frame;

said air distribution manifold further including:

a plurality of vertically oriented C-shaped conduits, at least one of said conduits positioned adjacent each of the opposed side walls of said enclosed combustion chamber;

each of said C-shaped conduits having a bottom leg for positioning adjacent said bottom wall, a vertical leg for positioning adjacent said front wall, and a top leg for positioning adjacent said top wall; said bottom, vertical, and top legs being in fluid communication with one another; said top leg having said plurality of first outlet openings; and, said bottom leg having said plurality of second outlet openings;

combustion air blowing means for blowing air through said plurality of first and second outlet openings for combustion of the fuel material;

a flue outlet extending from said combustion chamber for directing exhaust gases therefrom;

a plurality of heat exchange tubes horizontally and parallely disposed within said combustion chamber adjacent said top wall thereof, said heat exchange tubes being positioned in an inverted, pyramidal configuration;

air circulation means for circulating air through said heat exchange tubes, said air circulation means including a rear plenum disposed adjacent said rear wall and exteriorly of said combustion chamber, said heat exchange tubes being in fluid communication with said rear plenum; and a circulating air blower for delivering air to said rear plenum;

an electric circuit including:

(a) a limit switch for controlling said combustion air blowing means, said limit switch being located and adapted to sense the temperature within said flue outlet and being coupled with said combustion air blowing means to effect the termination of the air flow from said combustion air blowing means when the temperature in said flue outlet exceeds a preselected temperature, and (b) a thermostat for controlling said air circulation means, said thermostat being located and adapted to sense the temperature exteriorly of said furnace and being coupled with said air circulation means to effect the termination of the air flow from said air circulation means when the temperature exteriorly of said furnace exceeds a preselected temperature.

* * * * *